United States Patent [19]

Hudson

[11] 4,024,704

[45] May 24, 1977

[54] COMBUSTION PRODUCTS PRESSURE GENERATOR CONTINUOUS BURNER TYPE AND ENGINES

[76] Inventor: Perry D. Hudson, 515 Delaine Drive, Corpus Christi, Tex. 78411

[22] Filed: Aug. 28, 1972

[21] Appl. No.: 284,431

Related U.S. Application Data

[63] Continuation-in-part of Ser. No. 74,703, Sept. 23, 1970.

[52] U.S. Cl. ..... 60/39.25; 60/39.5; 60/39.51 R; 60/39.62; 60/39.67; 60/39.81; 91/9; 91/155; 91/248; 91/421

[51] Int. Cl.[2] ..... F02G 1/02; F02G 3/02; F01B 29/04; F01L 25/08

[58] Field of Search ..... 60/39.15, 39.2, 39.16 R, 60/39.25, 39.6, 39.62, 39.63, 97 R, 97 B, 97 P, 65, 68; 91/8–10, 248, 35, 39, 155, 421; 123/193 P, 41.41; 92/176, 215

[56] References Cited

UNITED STATES PATENTS

| | | | |
|---|---|---|---|
| 281,579 | 7/1883 | Storer | 91/248 |
| 581,385 | 4/1897 | Woillard | 60/39.16 |
| 611,125 | 9/1898 | Humphrey | 60/39.6 X |
| 870,375 | 11/1907 | MacLachlan | 91/11 |
| 940,474 | 11/1909 | Piestrak | 60/39.63 |
| 1,034,026 | 7/1912 | Nordberg | 60/65 |
| 1,130,148 | 3/1915 | Collier | 60/39.33 |
| 1,228,048 | 5/1917 | Rich | 92/215 |
| 1,386,144 | 8/1921 | Wall | 92/176 |
| 1,390,399 | 9/1921 | Swartwout | 91/11 |
| 1,445,794 | 2/1923 | Osbourn | 91/248 |
| 2,243,263 | 5/1941 | Starr | 92/215 |
| 2,413,751 | 1/1947 | Dennis | 92/176 |
| 2,672,854 | 3/1954 | Brubaker | 123/41.41 |
| 2,688,230 | 9/1954 | Milliken | 60/39.63 |
| 3,088,276 | 5/1963 | Hudson | 60/39.6 |
| 3,577,729 | 5/1971 | Warren | 60/39.63 |

FOREIGN PATENTS OR APPLICATIONS

| | | | |
|---|---|---|---|
| 423,779 | 4/1911 | France | 60/39.6 |
| 529,786 | 11/1940 | United Kingdom | 60/39.16 R |

*Primary Examiner*—C. J. Husar
*Assistant Examiner*—Robert E. Garrett

[57] ABSTRACT

This application pertains to reciprocating piston engines supplied hot pressure fluid medium by combustion products pressure generators and controls thereof.

This invention pertains to a new improved electro magnetic operated automatic, reversible cut off system for the pressure fluid medium admission valves to the power cylinders of reciprocating piston engines. To control the power and speed thereof. Controlled by speed governor or manual means.

This invention pertains to a new improved electro magnetic operated automatic cut off system for the pressure fluid medium admission valves to the high pressure power cylinders of a reciprocating piston engine. Used as a pressure reducing means controlled by the pressure on the exhaust to the low pressure cylinders. This means is especially suitable where the pressure of the fluid medium varies widely.

A combination of the two above described cut off control systems used together on a multi cylinder reciprocating piston engine. This combination makes possible the economical use of a high pressure fluid medium the pressure which fluctuates widely.

This invention also pertains to the use of the two above described cut off control systems in combination with a combustion products pressure generator supplying pressure fluid medium to converted gasoline, gas or diesel engines used as the low pressure power section of the combined engine.

This invention pertains to heat saving extended insulated, hot head pistons and extended insulated hot cylinder walls in combination with improved insulated cylinder heads.

6 Claims, 13 Drawing Figures

DILUTION ZONE
COMBUSTION ZONE
PO-1
PO-2

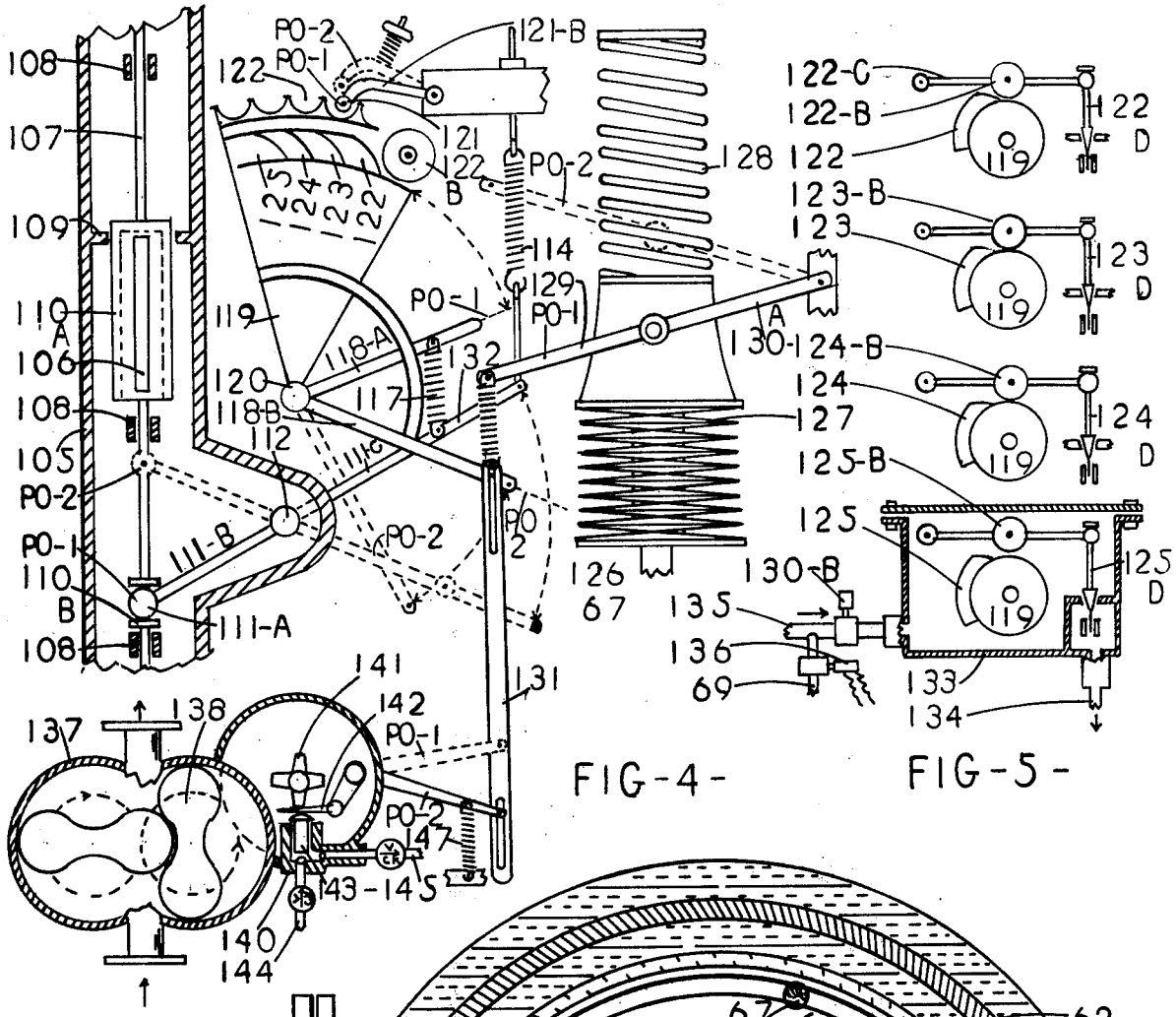
FIG-4-
FIG-5-
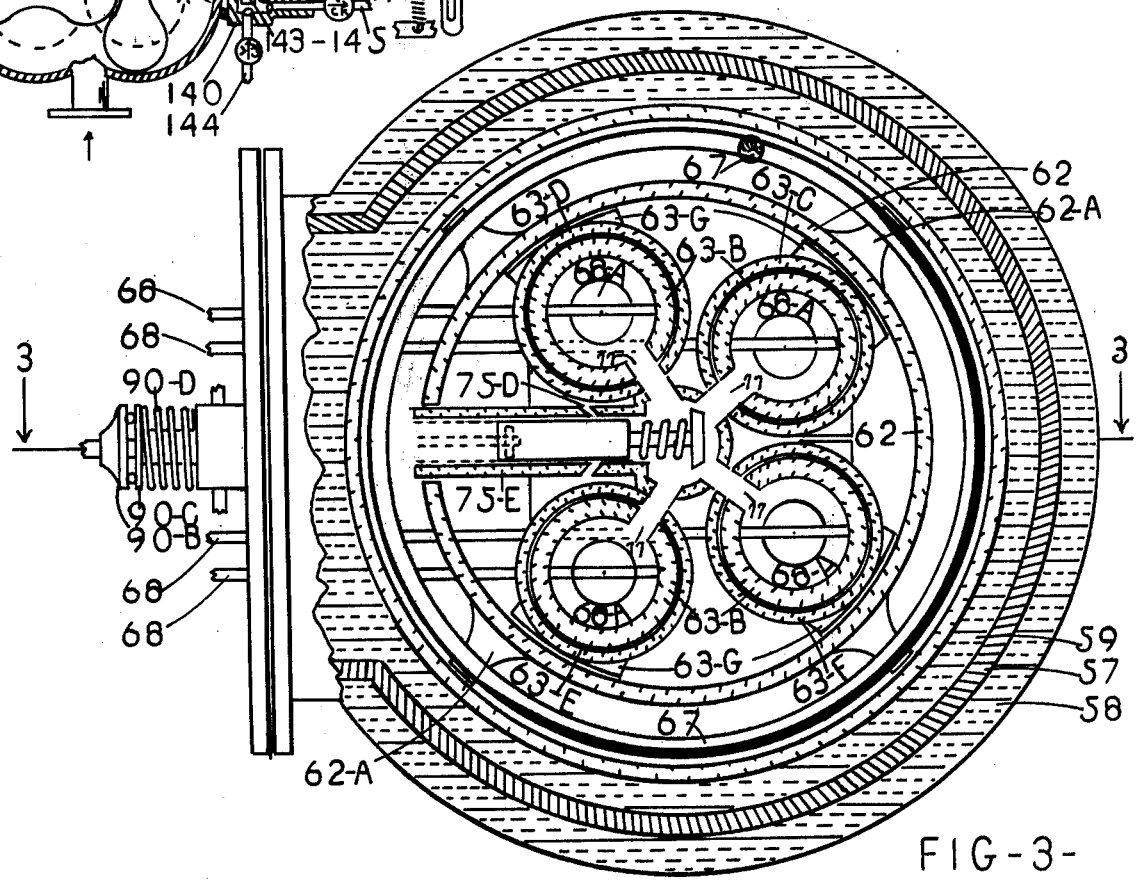
FIG-3-

COMBUSTION PRODUCTS PRESSURE GENERATOR CONTINUOUS BURNER TYPE AND ENGINES

This is a continuation in part of application Ser. No. 74,703 filed Sept. 23, 1970.

This application covers the engines, automatic cutoff valve gear, automatic changeover from simple to compound operation when the engine exceeds a predetermined RPM, and back to simple operation if the engine speed drops below the predetermined RPM. Also, covers a new and improved pressure reducing system, consisting of a automatic cutoff for the fluid medium valves to the high pressure cylinders. The amount of FM admitted each power stroke to the high pressure cylinders is controlled by the pressure in the low pressure manifold into which the high pressure cylinders exhaust.

This invention relates to an improved system of providing combustion air to the combustion products pressure generators by multiple stage air compressors with interstage coolers having a variable capacity controlled by automatic unloading of the suction valves of the low stage compressor cylinders or a variable clearance means on the low pressure cylinders. This makes it possible to maintain a constant predetermined pressure on the combustion products generators and the air accumulators.

This invention relates to an improved system of providing instant starting power, quick lighting of the pilot and burners, complete burning of the fuel with minimal heat loss, and nearly pollution free emissions combined with great fuel economy.

This invention relates to improved burners and pilot inside the combustion chamber. Multiple burners can be used in the larger capacity units, with a means of burning the pilot only, one burner, or several burners to heat the air required by the load on the prime mover. Thus, each burner is used at its most efficient capacity, insuring nearly perfect combustion and very little air pollution.

This invention relates to an improved fuel-air ratio control combined with a heat control, with instantaneous response to wide load changes from full load to no load, to stop and start again all in a few seconds to meet vehicle propulsion requirements of direct drive without a transmission.

This invention relates to improved fuel to air ratio control by with a means of a positive displacement meter drive of a fuel metering pump to accurately measure the fuel in ratio to the flow of combustion air into the combustion chamber.

This invention relates to an improved electrical changeover system from compound operation of the engine to simple operation automatically or manually to insure smooth, powerful operations at very low speeds or extra power when needed.

This invention relates to an improved system to cut off the flow of hot, high pressure gases to the high pressure power cylinders at the precise point in the power stroke for the greatest expansion of the gases in ratio to the power required.

This invention relates to a system of propulsion of vehicles without a clutch or transmission between the engine and the driving wheels, combined with a system of using the compression of the engine and compressor as a running or coasting vehicle brake.

This invention relates to improved heat saving extended pistons with insulated piston heads, which save the heat of the fluid medium. The invention also employs extended, insulated hot cylinder walls.

This invention relates to a cool air blocking system for the extended pistons which keeps the hot gases away from the lubricated, cool cylinder walls.

This invention relates to improved pistons with insulated piston heads. These last three improvements help cut down on the heat losses.

This invention relates to an improved Vee-type engine with a continuous burner-type combustion chamber and a heat exchanger on the exhaust to preheat the combustion air. This engine can be used with or without the cutoff system or automatic change over from simple to compound at a predetermined RPM. These engines are designed for use with slide gear or automatic transmission.

This invention relates to an improved air to fuel ratio and heat limit control system combined with an improved operating system for use with slide gear or automatic transmissions.

FIG. 1 shows a section view in elevation of the engine on section line 1—1 FIG. 8. This view shows the high pressure power cylinder with details of the construction of the extended piston, extended hot cylinder wall, blocking air, etc.

FIG. 2 shows a sectional view in elevation of the combustion chamber on section line 2—2 of plan view 8 and section line 3—3 of FIG. 3, showing the retractable ignitor, pilot, four burner plan, fan bearings, shaft seal, and blocking air arrangement.

FIG. 3 shows a plan view of the combustion chamber shown in sectional elevation in FIG. 2 on section lines 3—3 of FIG. 3. This shows the four-burner arrangement, retractable ignitor, etc.

FIG. 4 shows the volume meter which controls the number of burners operating in ratio to the volume of gases being used, and the heat limit thermometer which controlls the head limit in the combustion chamber.

FIG. 5 shows the cam which turn on the burners progressively one at a time according to the volume of gases used, and cuts off the burners one at a time as gas use volume decreases.

FIG. 4 shows a positive displacement meter controlling the volume of fuel pumped to the burners, thus maintaining the correct fuel to air ratio. This can be used in conjunction with the volume meter, and heat thermometer as shown, or can be used separately.

The following abbreviations are used in this specification: RPM, revolutions per minute. PSI, pounds per square inch. LP, low pressure. HP, high pressure. CPPG, Combustion products pressure generator. FM, the hot, high pressure gases produced by the combustion products pressure generators.

Figure 11:
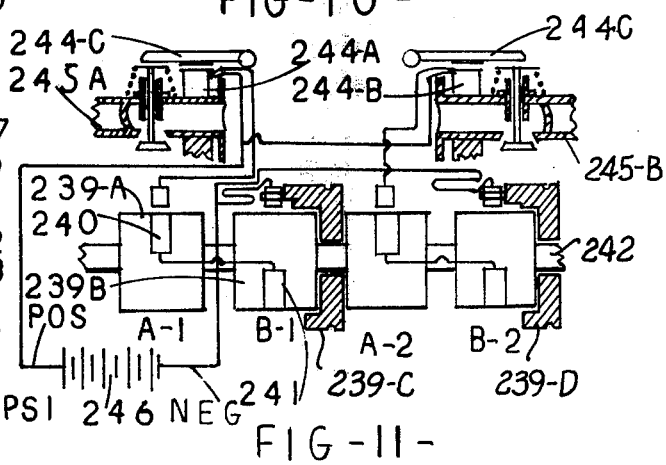
FIG. 11 shows a diagrammatic view of the electric circuits and electric contact drums. Also shown are the admission valves on two power cylinders.
Figure 12:
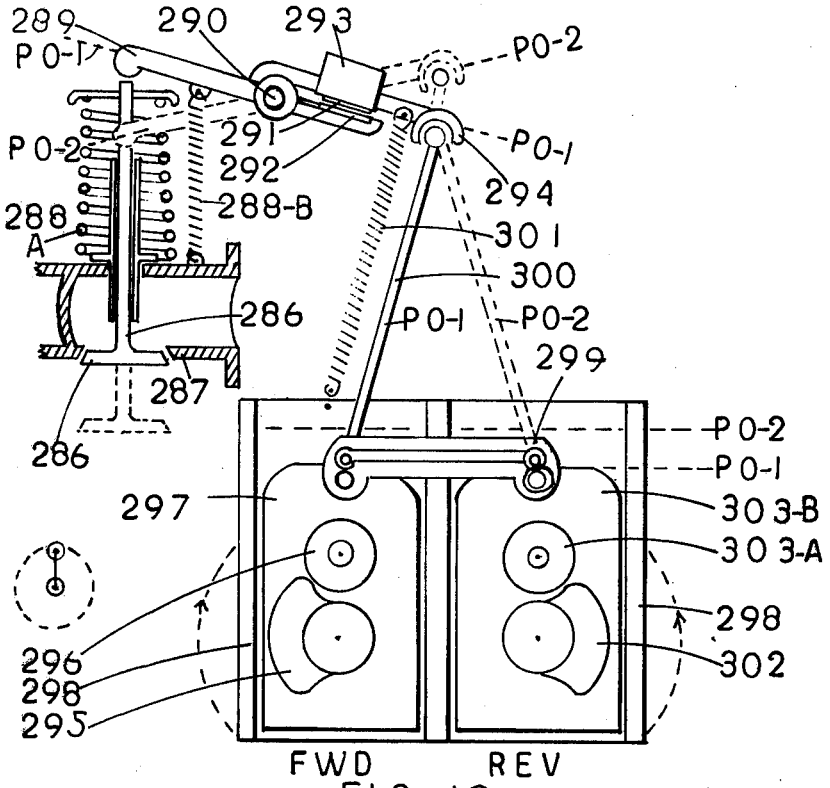
Figure 13:
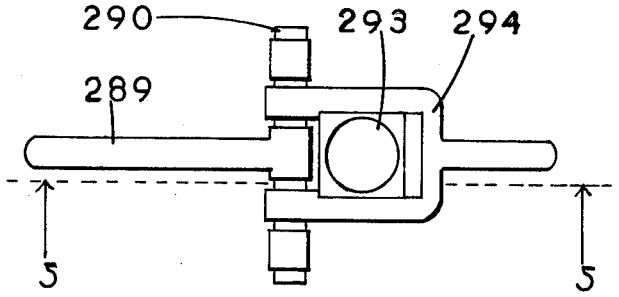

FIG. 12 shows a side view in elevation, part in section, on lines 5—of FIG. 13 of a cutoff mechanism and cam reversal system for the FM admission valves to the power cylinders. This system is different in some respects from the systems shown in FIGS. 6, 10 and 11. The systems shown in FIGS. 6, 10 & 11 use the electro magnets to open the valves. The valve springs close the valves when the solenoid magnet releases the valve.

The system shown in FIGS. 12 & 13 uses the electric contact system to time the release of the valve, which is mechanically opened and reversed by the dual camshaft arrangement shown in FIG. 12. This system is especially designed for large engines where opening the valves takes considerable power.

It should of course be understood that the description and drawings are illustrative merely, various modifications and changes may be made in the structure disclosed without departing from the spirit of the invention. Like numerals refer to like parts throughout the several views.

Figures 1, 2:
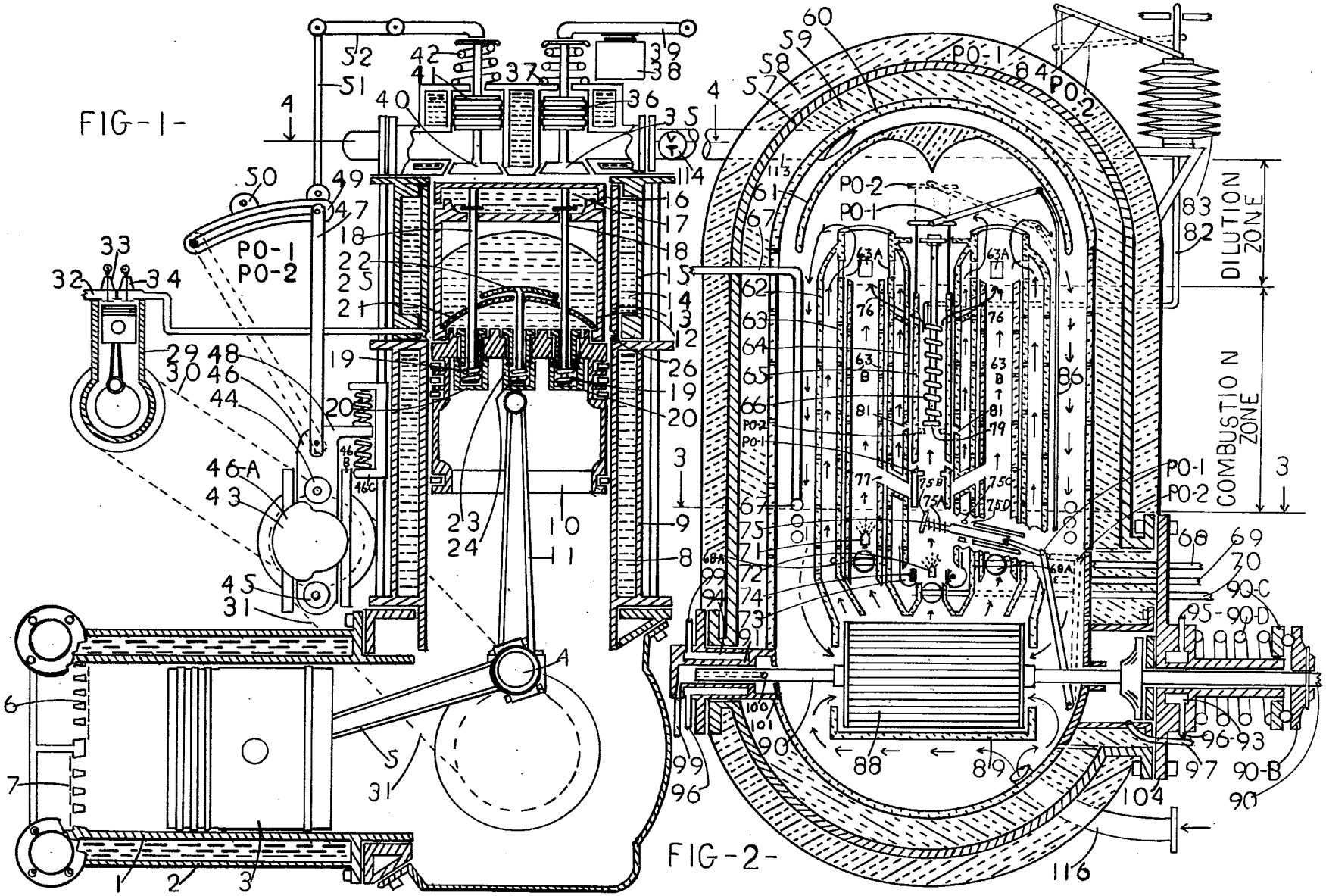

Referring to the drawings, FIG. 1 is a sectional side view in elevation of one of the extended pistons and extended cylinder walls for the high and low pressure power cylinders. This view shows one of the high pressure compressor cylinders of a engine having two high pressure and two low pressure power cylinders and four compressor cylinders. All are single acting, and are designed to operate on the hot pressure fluid medium produced by combustion products generators.

Referring to the compressor, 1 is the cylinder, 2A the liquid cooling jacket for the cylinder, 3 is the compressor piston connected to the crankshaft 4 by connecting rod 5. The compressor intake valve is 6, and the outlet valve is 7, both flat reed-type valves. The power cylinder is 8, with liquid cooling jacket 9, The pistons 10 is connected to crankshaft 4 by connecting rod 11. The extension on the hot head piston is 12. The hot cylinder wall extension 13 is insulated by insulation 14 from outer pressure holding cylinder wall 15. The hot head of the piston 16 is insulated by insulation 17 from piston extension 12, and is secured by bolts 18 to power piston 10, tensioned by stiff holding springs 10, and sealed pressure tight by cap 20. Circular clamp 21, pressured by bolt 22, holds hot head piston extension secured and centered to power piston 10 by tension spring 23, sealed pressure tight by cap 24, and insulated by insulation 25 from piston 10, FIG. 1. Hot cylinder wall 13 has a blocking air distributor groove 26 all the way around the bottom. Said groove is in communication with blocking air conduit 27 and supplied by blocking air metering mechanism 29. This metering mechanism consists of a small reciprocating piston compressor driven at engine crankshaft speed by silent chain 30 from the camshaft, which is driven at crankshaft speed by silent chain 31 from main engine crankshaft.

This metering mechanism is supplied with cool 600 PSI air from main compressor 1. Describing operation of the extended hot head piston with blocking air, it is designed to keep the hot gases away from the main pressure sealing piston 10 and the lubricated and cooled cylinder wall 8, thereby conversing the heat in the hot gases. The piston extension 12 clears the hot cylinder wall 13 by 0.010 to 0.040 thousandths of an inch. Cylinder wall 13 is insulated from outer pressure holding cylinder 15 by insulation 14, and is fit to allow for expansion vertically and in diameter when hot. The compression of holding springs 19 and 23 holds the piston extension and hot head fast to the main piston, but allows for vertical and in-diameter expansion. Clamp 21 and holding bolt 22 hold it centered with main pressure sealing power piston 10. The blocking air compressor and metering device 29 is driven at crankshaft speed, and in exact time with the crankshaft, by silent chain 30 off the camshaft, which is driven at crankshaft speed by silent chain 31, FIG. 1.

The volume capacity of blocking air piston in compressor 29 is the same or slightly more than the volume capacity of the 0.010 to 0.040 thousandths of an inch clearance between the hot cylinder wall 13 and hot piston extension 12. As the piston 10 travels on the exhaust stroke, the clearance space between the piston extension walls and the cylinder walls is filled with cool blocking air at 600PSI or less, so that when high pressure charge valve 35, FIG. 1, opens, the hot gases cannot go into the clearance space. As the piston goes down on the power stroke, the hot gases above the piston holds the cool gases in the clearance space. On the upward stroke, the air in the clearance space is forced out by the fresh charge of blocking air. Thus, the hot gases do not come in contact with anything except the hot cylinder wall 13, piston extension 12, and hot piston head 16. Thus, very little heat is lost. Air is supplied to air blocking compressor via inlet 32 through mechanical cam operated inlet valve 33 and discharge valve 34. Air is supplied from high pressure compressor line 195, FIG. 7.

The high pressure gases are admitted to the high pressure power cylinder by valve 35, which is balanced by piston 36 and closed by spring 37. Valve 35 is opened by electric solenoid 38 via lever 39. The electrical valve operating mechanism is described later.

Exhaust valve 40 is balanced by piston 41 and closed by spring 42, and is operated by cam 43 which strikes rollers 44 and 45. The rollers are rotatably secured to cam follower slide 46, which slides in guides 46A, and which is moveably secured to push rod 47. Push rod 47 is slideably attached to rocking reverse quadrant 49, which is pivoted on pin 50. This motion, transmitted via push rod 51 and rocker arm 52 opens and closes exhaust valve 40. When push rod 47 is in position 1, (PO-1) the valve is operated for clockwise rotation of the engine. When push rod 47 is in position 2, (PO-2), on rocking reverse quadrant 49, the valve is operated for counter-clockwise rotation of the engine. The top part of the cam follower has an arm 48 extending right and engaging light springs 46B, which are held by bracket 46C. These springs return cam follower 46 to a center or "neutral position after valve is closed." This is required as cam 43 pushes rollers 44 and 45 both up and down each rotation. The downward motion on clockwise rotation of the engine just swings rocker arm 52 up away from the valve. However, with push rod in PO-2 in reversing quadrant 49 for counter clockwise rotation of the engine, this downward motion would open exhaust valve 40. The exhaust valves are to close far enough ahead of top dead center to achieve compression equal to the charge pressure of that cylinder. This would cushion the stopping of the piston at the end of the stroke and cancel out the clearance loss.

Figure 7:
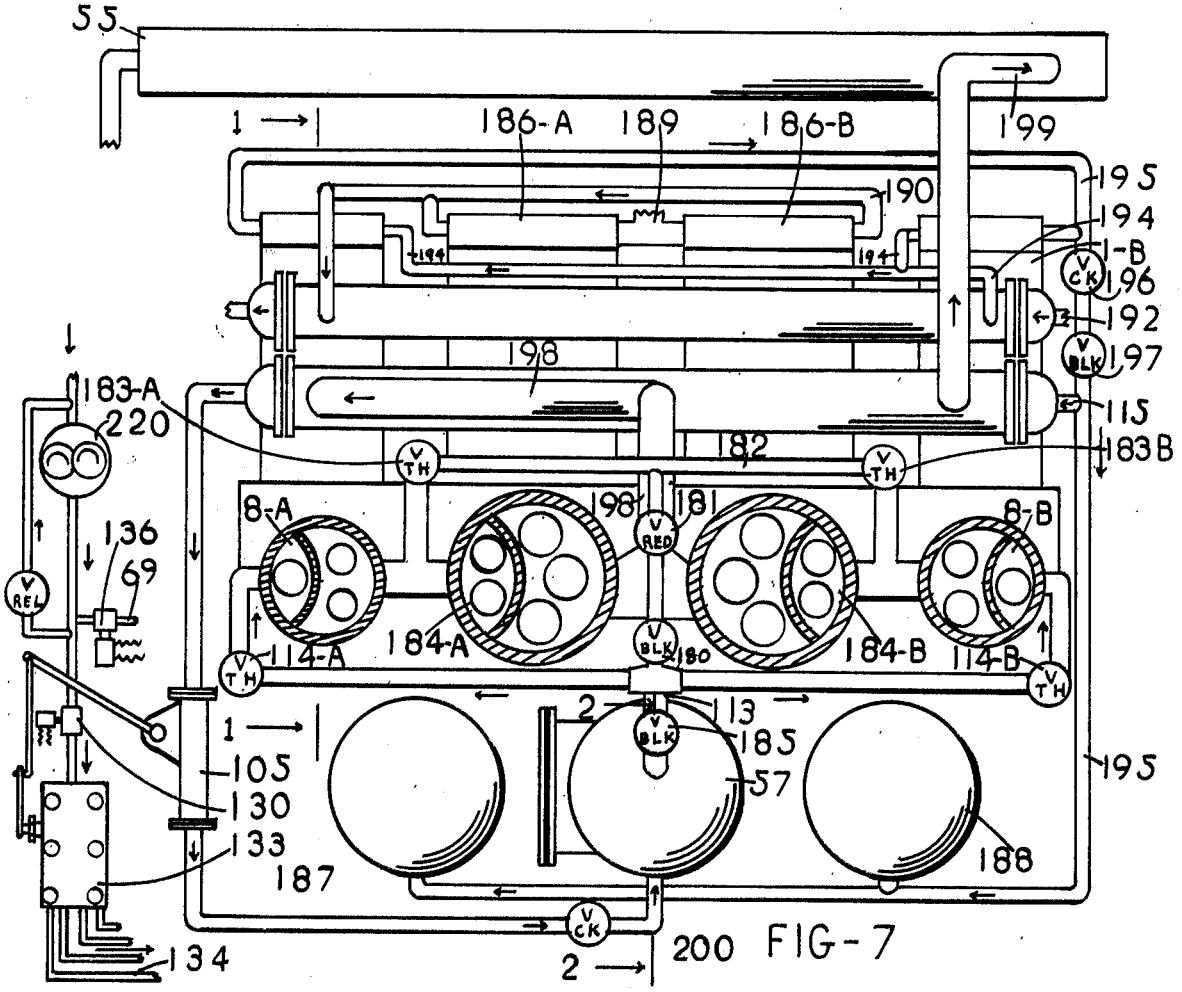
FIG. 7 is a plan view of engine and combustion products generator shown in FIGS. 1 and 2, with a general flow chart.

The interstage cooler exchanger for the compressor is 53, FIG. 7. The air preheater or regenerator exchanger is 54. The air cooled exhaust condenser is 55. The condensate drain to the holding tank is 56 (Holding tank not shown.)

Figure 6:
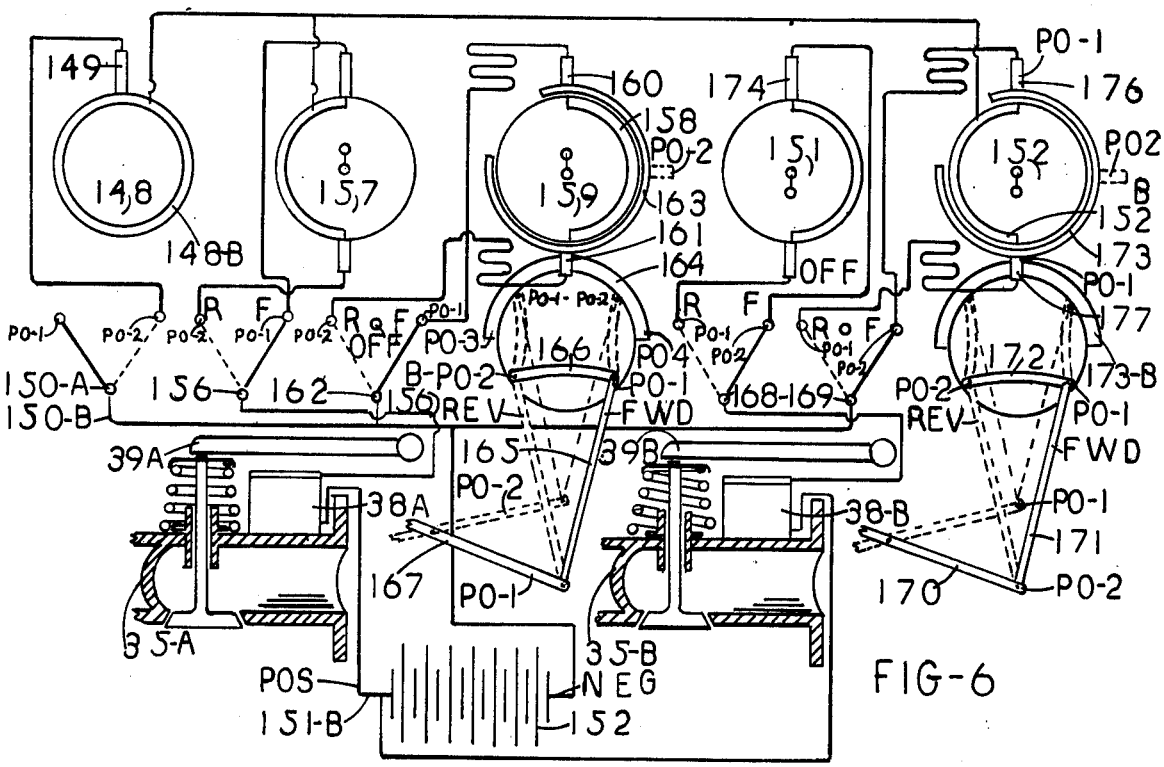
FIG. 6 shows the electric solenoid operating mechanism for the charge valves for the high pressure cylinders. This mechanism includes the automatic cutoff mechanism, also the changeover means "from cutoff compound" operation, to simple operation for all four of the power cylinders.

FIG. 6 shows a schematic view of the electrically operated valve operating system for the high pressure cylinders. This system gives the option of either forward or reverse operation of the engine using full throttle control of the four-cylinder, simple engine operation, or a variable cutoff point from the valves not opening at all to 50 percent of the power stroke charge, with the high pressure cylinders exhausting into low pressure cylinders in a full compound operation. The compound operation uses the variable cutoff instead of the throttle to control speed of the engine. This system is instantly convertable from simple to compound and back to simple with the engine running full speed.

The electrical contact drum or commutator (sectionalized for better illustration) consists of a round drum of non-conductor material long enough for five separate electrical contact rings. This drum rotates at crankshaft speed. The metal electric contact segments are inlaid into and secured there in much the same manner as a commutator on a slip ring electric motor. The segments are spaced in exact relationship to the position of the engine crank on the cylinder served. The inlaid segments are interconnected to each other by circuit 150B and to the "ground" control ring 148B, which segment is all the way around the drum and makes continuous contact with an electric contact brush 149, which has an electric off and on switch 150-A.

The OFF position of switch 150-A means "cut off to the valves in operation," and the engine is operating as a compound engine. The ON position of switch 150-A means that the "cut off is NOT in operation". The charge valves to the high pressure cylinders are open the full power stroke, 180°, and the engine is in "SIMPLE" operation on all four power cylinders.

The segment 153 in contact ring 157 only goes 180° of the circle and has an electric contact brush 154 for forward or clockwise rotation of the engine.

Contact brush 155 is for counter-clockwise rotation, and is connected to the reverse side of the reversing switch 156, which is marked F for forward or clockwise rotation of the engine, and marked R for reverse or counter clock wise rotation of the engine. The symbol in the center indicates the position of the engine crank in relation to top dead center and in relation to the segments in the contact drum or ring. The electric contact segment 158 of contact ring 159 only goes 180 degrees of the circle. The crank position in relation to the segment is shown just above the numeral 159. The forward contact brush is 161. The reverse brushes are connected by flexible conductor cords to the reversing switch 162. Contact brushes 160 and 161 are mounted on a oscillating carrier 163 which has a spur gear for 200° from PO-5 to PO-6, which engages a spur gear on reversing quadrant 164 having a spur gear 200 degrees from PO-3 to PO-4. When cutoff operating rod 165 is in PO-1 in slide 166 and is moved upward from PO-1 (or OFF) to PO-2 by cut off operating lever 167, this rotates the brush carrier 163 clockwise, bringing brush 160 to PO-2 so that when segment 158 and the crank shaft turns 90 degrees clockwise, contact between brush 160 and segment 158 is broken. When this contact is broken, valve 35-A closes.

The battery or other source of power is 152-C. The positive side is connected to one lead wire of solenoids 38-A and 38-B which operates inlet valve 35-A or B, FIG. 6, via lever arm 39. The negative lead of the battery is connected to switches 150-A, 162 and 169. As switch 150-A is in PO-1 (or OFF) position and as switches 156, 162, 168 and 169 are all in PO-1 or clockwise rotation position, the circuit for electric solenoid magnet 38-A is through switch 156 to brush 154. When crank 157 is 5 degrees past center, segment 153 comes in contact with brush 154. This completes the circuit via 150-B to segment 158 in track 159. When brush carrier 163 is in PO-1 there is no contact between segment 158 and brush 160. However, if the brush carrier is in any position between PO-1 and PO-2, then brush 160 is in contact with segment 158. This would complete the circuit with current from the battery 152-C flowing through conductor 156-B, through switch 156 to brush 154, which is in contact with segment 153, and as segment 153, via conductor 150-B, is connected to segment 158, which is in contact with brush 160, then through switch 162 to the negative post of battery 152-C. Thus the circuit is closed, magnetizing magnet 38, and opening valve 35. When segment 158 breaks contact with brush 160, the circuit is broken, and valve spring 37 closes valve 35. Thus with lever 167 in PO-1, valve 35 would not open at all as segment 158 would be past brush 160 before segment 153 made contact with brush 154. But if brush holder 163 was turned clockwise, say 25°, brush 160 would stay in contact with segment 158 until 25° after top dead center, at which time contact would be broken between brush 160 and segment 158, closing valve 35. Thus, in cutoff operation, the position of brush 160 between PO-1 & pO-2 would govern the amount of pressure fluid medium admitted to the cylinders, thereby governing the speed of power of the engine. The throttle lever or accelator pedal of the governor would control the position of levers 167 & 170.

To reverse the engine, electric switches 156, 162, 168 and 169 are placed in PO-2, and levers 165 and 171 swing over from PO-1 to PO-2 in the reverse quadrants 166 and 172. This energizes contact brushes 155 on contact track 157, and brush 161 on track 159, brush 175 on track 151, and brush 177 on track 152-B.

Describing the action of contact drum 159, in PO-1 contact brush 161 is not contacting segment 158, hence valve 35 is closed. But if cutoff operating lever 167 is moved from PO-1 to PO-2 this would turn oscillating brush holder 163 counter-clockwise 90 degrees. This places contact brush 161 in PO-2 so that brush 161 would contact segment 158 until crank 159 had reached side center 90°, or 50% of the power stroke. Any position of lever 167 between PO-1 and PO-2 would open valve 35 at that position.

To take cutoff out of operation and change to simple operation on all four cylinders with clockwise rotation, switch 150-A is moved to ON, or PO-2, and switches 162 and 169 are moved to center, or off, positions. Thus the circuit is from the negative side of the battery through switch 150-A, into contact segment 148-B via brush 149 to circuit 150-B inside the contact drum, which connects all the contact tracks together; thence to contact track 157, to segment 153, to brush 154 thence to electro magnet 38-A to the positive side of the battery. Thus on track 157, anytime, contact brush 154 is in contact with segment 153, valve 35 would be open the full 90 degrees of the power stroke of the piston on clockwise rotation.

On counter-clockwise rotation, switches 156 and 168 would be in PO-2, so contact brushes 155 would be in contact with segments 153 and brush 175 would be in contact with segment 178. When cutoff is taken out of operation by moving switch 150-A to PO-2, this movement also opens solenoid operated block valve 180, FIG. 7 admitting 600PSI gases to flow through pressure reducing valve 181 and pressuring manifold to 100 PSI. This pressure to the low pressure cylinders 184-A is controlled by throttle valves 183-A, 183-B. The 600 PSI gases to the high pressure cylinders 8-A, 8-B is controlled by throttle valves 114-A, 114-B. These four throttle valve operating linkages are all connected together to operate as one on the simple engine operation. On compound cutoff engine operation, only the 114-A, 114-B throttle valves operate. These are linked with cutoff controll levers 167 and 170 so as to stay open enough so that the incoming gases are not throttled enough to reduce the pressure to the high pressure inlet valves 35-A, 35-B. But when the engine operation is changed to simple, the throttle valves 114-A, 114-B and 183-A, 183-B close down to take full control of the engine operation.

The advantage of switching to simple operation at low speeds or starting up cold, is that it gives power to the big low pressure cylinders 184-A and 184-B, FIG. 7 to move a heavy load from a standing start smoothly and with great power. As soon as the engine has reached 100 to 200 RPM, then the engine can be changed to a compound operation either manually or automatically. This is a great advantage when the engine is connected to drive the wheels of a vehicle at or near the speed of the engine without a clutch or transmission. It gives a "low gear" or leverage to start a heavy load from a standing start smoothly.

FIG. 7 shows a schematic plan view, partly in section, showing the power cylinder heads cut on section line 4—4, FIG. 1 showing the intake and exhaust valves of the power cylinders. The high pressure power cylinders are 8-A and 8-B. The low pressure power cylinders are 184-A and 184-B. The two high pressure compressor cylinders are 1 - A and 1 - B. The two low pressure compressor cylinders are 186-A and 186-B. The air compressor interstage cooler is 53. The combustion air preheater is 54, which uses the exhaust to preheat the combustion air after compression. The exhaust gas condenser is 55, and the gas and liquid outlet is 56. The liquid goes to a holding tank (not shown) to be drained at intervals. If the chemical content is high enough it could be collected at the service stations and sent to a chemical plant for reclaiming contents. Condensing the exhaust should reduce the emissions greatly.

The combustion products generator or expansion chamber is 57 shown in section, FIGS. 2 and 3. The air storage receivers are 187 and 188. The intake to the low pressure compressor cylinders is 189. The outlets are 190, which are connected to line 191, which goes to the shell side of the interstage cooler 53. The cooling medium inlet is 192 and outlet is 193. The air then passes around the tubes filled with cooling medium, and out the right hand end in line 194, thence to the intakes of the high pressure compressor cylinders 1 - A and 1 - B into line 195. It then passes through check valve 196, block valve 197, and into line 115 into the tube side of the air preheater exchanger 54. The hot exhaust from the low pressure power cylinders 184-A and 184-B passes into manifold 198 into the left hand end of the shell side of exchanger 54, through baffles, and out exhaust line 199 to exhaust condenser 55. The combustion air passes through the tubes of the exchanger from right to left counter flow to the hot exhaust, heating the air to approximately 800° F, thence through line 116, and check valve 200 into the bottom of combustion chamber 57 through inlet 116 FIG. 2. Line 195 extends around to air receivers 187 and 188. These receivers float on the line, holding 600 PSI on the combustion chamber at all times. This acts as a reserve of air for sudden demands for lots of power over a short period of time, or when the engine is shut down and solenoid or other servo operated block valves 180, 185 and 197 are closed. This considerable supply of air in the combustion chamber from the two air receivers and preheater tubes is sufficient to operate the engine for several minutes from a cold start and while the burners are lighting up and getting hot, and the engine has attached enough RPM for the compressor to start operating.

The air receivers can be located some distance from the engine, in a convenient location. In an automobile, there is a space in back of the rear seat. With a front end drive and dropped center rear axle, there would be considerable room in back of the rear seat for air receivers, with the connecting line running beneath the floor boards to the combustion chamber. The heating of the air from the receivers from 100° to 1600° F. would increase the volume 3.68 to one.

Figure 8:
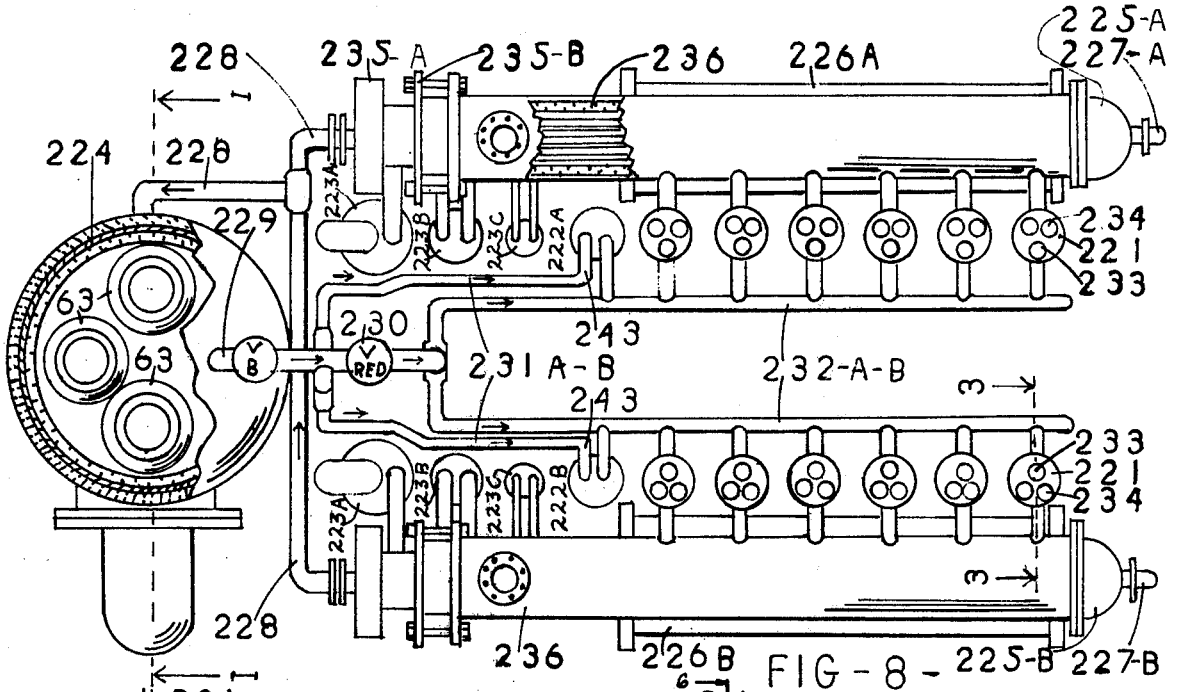
FIG. 8 shows a plan view of a large multiple cylinder combustion products generator engine.

FIG. 8 shows a plan view of a multiple cylinder reciprocating piston engine and compressor. The compressor supplies combustion air to a constant pressure combustion products generator, which supplies the engine with the hot pressure fluid medium needed to drive the engine.

FIG. 8 shows a twelve cylinder V-type engine, which could be a gas, gasoline, or diesel engine that has been converted to a combustion products generator engine by adding two or more high pressure power cylinders 222 A & B, and a six cylinder, three stage air compressor section 223 A, B & C. The combustion products generator is 224, with the exhaust heat recovery exchanger 225 A & B. The interstage coolers for the compressor are 226 A & B. 221 are two of the twelve Low Pressure power cylinders. 222 A & B are the High Pressure power cylinders which reduces the 1000 PSI hot FM from the CPG to 400 PSI for the consumption of the Low Pressure cylinders. 223 A is the low pressure compressor cylinders; 223 B are the intermediate pressure compressor cylinders; 223 C are the high pressure compressor cylinders of the air compressor. 227 A & B are the high pressure manifolds from the compressors into the tube side of the exhaust heated heat recovery exchangers 225 A & B, which heat the combustion air to 700° to 1000° F. before entering the CPG 224 at the bottom at an average of about 800° F. through combustion air line 228, FIG. 8. The combustion air is circulated through the burners 63 by fan 88, FIG. 2. A portion of the air from fan 88 goes up through burner barrel jacket 62, through apertures 63 A, into the hot gases of combustion, diluting the hot gases to workable temperatures.

The air or gases within the CPG are heated to, for example, 1600° F. by the burners. The burners are controlled by a combination of a flow metering means on the incoming combustion air, and a temperature control means within the CPG. The flow metering means lights the burners when the cool air starts coming into the CPG. These controls and the combustion products generator are covered by FIGS. 3, 4, 5 in the parent application 74,703, filed September 23 1970. 23, The hot high pressure gases or "FM" flow from the CPG through the HP line 229, branch line 231, to HP cylinders 222, which reduce the pressure from 1000 PSI to 400 PSI. The high pressure cylinders 222 A and 222 B exhaust at 400 PSI into the low pressure manifolds 232 A and 232 B, FIG. 9, which connects to the induction valves 233 on the twelve LP cylinders. These LP cylinders exhaust directly via exhaust valves 234 on each cylinder into the exhaust heat recovery exchangers 225 A and 225 B. The exhaust circulates around the tubes which contain the HP air going to the CPG. The tube bundle has a floating head 235 A and B mounted on the left hand end of the exchanger. This head has a sleeve attached to the back side of the head which slides in packing gland 235 B. This allows for expansion of the tubes lengthways in relation to the exchanger shell 236. Shell 236 has a thick layer of insulation on the inside to protect the shell from the heat of the exhaust and save heat loss.

Figure 9:
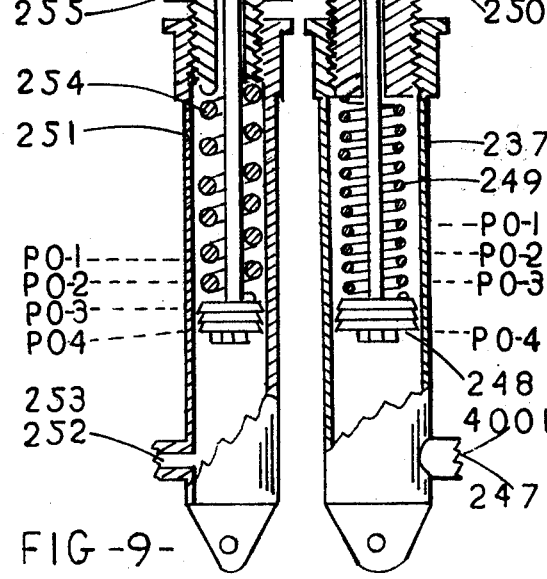
FIG. 9 shows the cutoff control mechanism on the high pressure; pressure reducing cylinders, and the FM admission valves.

In FIG. 9, 237 shows a side view in elevation, part in section, of the control cylinder which controlls the cutoff of the induction valves on the HP FM to the HP cylinders. 237 is the control cylinder which regulates the cutoff point of the high pressure induction valves so as to maintain 400 PSI in the LP manifolds 232 A & B at all times all the twelve L P cylinders.

Figure 10:
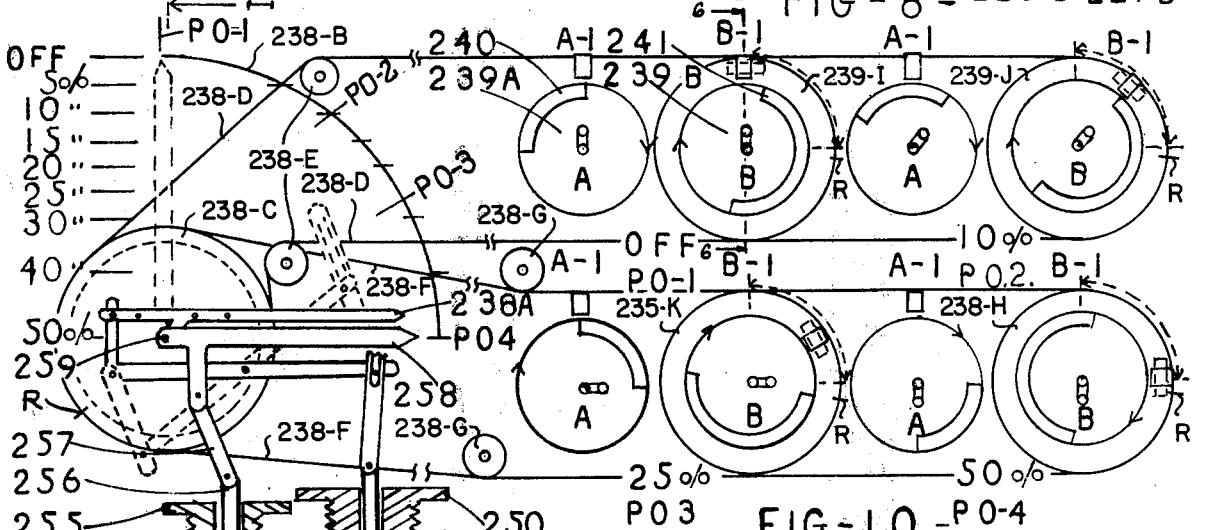
FIG. 10 shows the contact drums for the electric contact brushes the drums control the electro magnetic solenoids, which open the admission valves to the high pressure, pressure reducing power cylinders.

The indicator pointer 238 indicates the position of the oscillating electrical contact brush B 1, FIG. 10 and 11 on the revolving electrical contact drums 239 A, which revolves at crank shaft speed, in exact time with the engine crankshaft the symbol indicates the position of the crankshaft in each of the four positions of the contact drums shown in FIG. 10. The A-1, PO-1 indicates crank on top dead center, etc. 240 is the electrical contact segment in contact drum A. 241 is the electrical contact segment in contact drum B. B-1 is the oscillating brush on contact drum B.

FIG. 11 is a diagrammatic drawing showing two pairs or sets of contact drums on a shaft 242, which would be supported in suitable bearings and revolve at crank shaft speed in time with the cranks. The battery or other source of electric power is 246. This operates an electromagnet 244 A or 244 B to open each induction valve 245 A or 245-B. The power of these electromagents is timed by the contact brushes A-1 or B-1, FIG. 10, to open the induction valves to admit the proper amount of FM to the cylinders as is required by the pressure governor. The electrical contact segments 240 and 241 are internally connected to each other as shown. Thus as contact drums A and B revolve clockwise with brush B-1 in PO-1, contact between brush B-1 and segment 241 would be broken so that valve 245-A would remain closed. Brush B-1 in PO-2 would be in contact with segment 241 until 45 degrees after top dead center on the crank, or about 10% of the piston stroke on cutoff. Brush B-1 in PO-3 would cutoff at about 60° after top dead center, or 25% of the piston stroke. Brush B-1 in PO-4 would cut off the valve at 90° after top dead center, or 50% of the piston stroke, allowing the FM to expand the balance of the stroke and exhaust into the 400 PSI manifold 232 going to the LP cylinders.

Referring to control cylinder 237, FIG. 9, connection 247 below piston 248 is connected (via a pressure seal pot to put cool liquid against piston 248) to the 400 PSL fluid medium line 232 going to the LP power cylinders. This pressure acts against piston 248, which is restrained from upward movement by spring 249 against tension adjustment nut 250. Example: 450 PSI would move piston 248 from PO-3 to PO-1, cutting off the flow of 1000 PSI FM to the HP cylinders. 425 PSI would move piston 248 to PO-3, which would operate the cutoff at about 24.6% of the stroke, which should supply enough FM at 425PSI to the LP cylinders to pull the rated load of the engine. PO-4 would take care of a large overload. If for any reason the HP cylinders exhaust did not supply enough 425 PSI FM to meet the demands of the LP cylinder, speed governor, reducing valve 230, FIG. 9, would open at 400 PSI to supply the deficiency direct from the HP manifold 229, FIG. 8.

The high pressure cutoff control cylinders are designed to be used with the power system which uses three constant volume combustion products pressure generators of the two stage type as disclosed in application Ser. No. 189,444. As an example, CPPG,s of this type, using 1000 PSI compression, if filled with 1000 PSI-102° F. air and valves closed, and the air within the CPPG heated by exhaust and burners to 1600° F, should develop a pressure of 3000 to 3600 PSI. This HP is reduced by the high pressure power cylinders 222, FIG. 9, to 425 PSI, which is exhausted into the low pressure manifolds 232-A or 232-B via the high pressure cylinders 222, FIG. 8.

The amount of this HP FM admitted to these HP cylinders each stroke is controlled by control cylinder 237. The pressure connection 247 is connected to low pressure manifold 232 via a seal pot. This puts the 425 PSI pressure against piston 248. This pressure is balanced by spring 249, whose tension is adjusted by adjustment nut 250. If the pressure in the LP manifold falls below the predetermined pressure of, for example 400PSI, the spring 249 overcomes the FM pressure against piston 248 pushing it down toward PO-4 (as described in connection with FIGS. 8, 9, 10 and 11) increasing the charge. As the pressure rises in the low pressure manifolds 232 A & B, the the pressure beneath piston 248 increases, pushing the piston up toward PO-1, 2, or 3. This balances the flow of 425 PSI FM from the HP cylinders exhaust with the demands of the LP cylinders.

FIG. 9, indicator pointer 238A has a control cable drum 238-C attached to it and oscillates with it. In FIG. 11 the oscillating control brushes B-1 and B-2 are mounted as a oscillating brush control drums 239-C and 239-D which oscillates on shaft 242. These drums are shown in elevation and in section on section lines 6—6, B-1 FIG. 10 so as to show the electric control drums B-1 and B-2, FIG. 11.

The ends of control cable 238-F are anchored at point R on cable drum 238-C passes under pulleys 238-G and around cable drum 238-H on contact drum B - PO-4, FIG. 10, and is anchored at point R on control drum 238-H which is in PO-4 corresponding to the shown position of pointer 238-A in FIG. 9. The cable is 238-D shown running to the "B" control cable drums 239-I and 239-J is a diagrammatical illustration of how these contact drums could be positioned from cable drum 238-C and control cylinder 237. Other means may be used such as hydraulic, rods and levers or electric means.

Page 20, describing FIG. 15. This is a valve operating mechanism with automatic cutoff and reversal features. The automatic cutoff for the high pressure or low pressure admission valves to the power cylinders is accomplished on clockwise rotation by energized electro magnet 293, which locks the two sections 289 and 294 of rocker arm 289 together, just before cam 295 strikes cam follower roller 296 opening valve 286. The energizing of magnet 293 is accomplished by the electric cutoff timer similar to the one shown in FIG. 6 and described in detail on pages 8, 9, 10 and 11 of this specification.

The electrically controlled automatic cutoff operation of valve 35-A shown in FIG. 6 uses the electro magnet 38-A to open the valve. The timer deenergizes the magnet at the cutoff point allowing the spring to close valve 35-A, thereby, controlling the speed and power of the engine.

The electrically controlled automatic cutoff of the admission valve 286 shown in FIG. 15 is a substitute for valve 35-A shown in FIG. 6, but uses the electrical control system shown in FIG. 6. The difference in operation is that the two halves of rocker arm 289 is locked together by contact plates 291 and 292 which is magnetized by electro magnet 293 timed by the electrical control timer shown in FIG. 6. The actual opening of valve is accomplished by the cam 295 on clockwise rotation by cam 302 on counter clockwise rotation.

This system would use considerable less electric power than the system shown in FIG. 6 and would be better in large engines with large valves.

The system shown in FIG. 15 with the two camshafts would operate the exhaust valve of the HP cylinders and the admission and exhaust valves of the low pressure cylinders with regular rocker arms, same as number 52 shown in FIG. 1. Cams, cam followers, push rods and reversing links as shown in FIG. 15. This is a more compact valve gear than that shown for the exhaust valve in FIG. 1 where it is desirable to have an automatic cutoff on the low pressure cylinders. The same mechanism described for the high pressure admission valve would be used.

Cutoff control cylinder 251, FIG. 9, is designed and operates as a safety control. It acts to limit the maximum amount of the HP FM that control cylinder 237, via induction valves 243, can admit to the HP power cylinders each power stroke. The amount of HP FM admitted each power stroke is in ratio to the pressure in the HP manifold. Thus if a rupture should occur in the LP manifolds, which would throw control cylinder 237 wide open, control cylinder 251 would control the amount of FM admitted to the cylinders to a safe amount.

Cutoff control cylinder 251 has the pressure from the HP manifold connected below the piston at connection 252. 253 is the piston. 254 is the heavy counteracting spring. 255 is the spring adjustment nut. 256 is the piston rod. 257 is the connecting link to restraining lever 258, which pivots on pivot 259. (Note the manifold numbers used are from FIG. 8, but would correspond to similar manifolds in the high pressure CPPG.) The amount of FM admitted each piston stroke increases as the pressure in the HP manifold drops to the 1000 PSL compression pressure. By lowering restraining lever 258 toward PO-4, FIG. 9, this allows control cylinder 237 to take over control and to limit the amount of FM admitted to the HP cylinders each power stroke via the admission cut off, as described in connection with FIGS. 8, 9 & 10 and 11, and controlled by the pressure in the low pressure manifold 232.

If at any time the exhaust from the HP cylinders does not supply enough FM to the LP manifold to maintain the pressure above 400 PSI, the reducing valve 230, FIG. 8, opens between the HP manifold 229 and the LP 232 to maintain the pressure in the LP manifold at or above 400 PSI.

FIG. 12 shows a side view in elevation, part on section on line 5 of FIG. 13. This is a valve operating mechanism and cam reversal system for the FM admission valves to the power cylinders. 286 is the valve seated in cylinder head 287 by spring 288A and opened by rocker arm 289, which is pivoted on rocker arm shaft 290. 291 is the contact plate on rocker arm 289 which matches the contact plate 292 on electro magnet 293, which is mounted solid between the arms of rocker arm 294 and moves with it. When the magnet 293 is magnetized, the contact plates 291 and 292 are drawn and locked together, and rocker arms 289 and 294 move together. Thus when cam 295 revolving clockwise, strikes cam follower roller 296, moving cam follower 297 up in guides 298 to PO-2, this motion, transmitted via link 299 and push rod 300, moves rocker arms 289 and 294 from PO-1 to PO-2, opening valve 286.

Light spring 288-B holds rocker arm 289 in contact with valve stem 286 at all times. Cam 295 holds cam follower 297 in PO-2 until the piston is on bottom center. But if the electric current is cut off from magnet 293 at any time, this frees spring 288-A to close valve 286 and return rocker arm 289 to PO-1. When cam 295 completes the 180° turn, spring 301 brings rocker arm 294, rod 300, and cam follower 297 back to PO-1.

Both cam shafts turn the same way the crank shaft turns. Thus, to reverse the engine, push rod 300 is moved in slide link 299 to PO-2. Then as the engine turns counterclockwise, cam 302 strikes cam follower roller 303A, pushing cam follower 303-B up to PO-2, opening the valve via push rod 300 and rocker arms 289-294, as described before on clockwise rotation.

The possible applications of the described combustion products generators are very versatile. Engines using pressure generators can be built in many sizes and types, using the compressor suitable for the use the engine is designed for. They can be built for a charge pressure from 50 PSI up. Theoretically the higher the pressure the greater the efficiency. The example of a pressure of 600 PSI and an operating temperature of 1600° F for the pressure fluid medium, and the preheat of the combustion air after compression to 800° F. are mere examples of a desirable operating temperatures and pressures. The pressures and temperatures used can be suited to the use of the engine, the fuel used, and the operating condition.

With the foregoing and other objects in view, the invention resides in the novel arrangement and combination of parts and in details of construction hereinafter described and claimed, it being understood that changes in the precise embodiment of the invention herein disclosed may be made within the scope of what is claimed without departing from the spirit of the invention. Therefore, the invention is not limited by what is shown in the drawings and described in the specification, but only as indicated by the appended claims.

I claim:

1. I claim, in combination, a reciprocating piston engine using a pressure fluid medium for power, and comprising at least one power cylinder, a charge valve for each power cylinder; a valve spring biasing said valve in a closed position; an exhaust valve for each power cylinder; a rocker arm shaft; a charge valve rocker arm pivotally mounted on said rocker arm shaft and engaging said charge valve; valve operating push rods operatively engaging said rocker arm; two camshafts for selectively actuating said rocker arm, one camshaft for operating the charge and exhaust valves on clockwise rotation of said engine, one camshaft for operating the charge and exhaust valves on counter clockwise rotation of said engine, a means of switching the valve operating push rods from the clockwise rotation camshaft to the reverse camshaft for counter clockwise rotation, and switching back for clockwise rotation of said engine, each half of the charge valve rocker arms to be hinged on the rocker arm shaft, the two halves are locked together by a magnet and electro magnetic contact plates when the magnet is energized by an electric timer means; when the magnet is de-energized by said electric timer; the charge valve is closed by said valve spring; a means to reverse the sequence of charge valve closing by said contact timer at the same time push rods are switched from clockwise rotation camshaft to counter clockwise rotation camshaft, said electric contact timer means to energize each of said magnetic plates in sequence so that the said camshafts will open each charge valve in sequence when the piston in that power cylinder is on top dead center of the power stroke, said electric contact timer to have a variable contact means to de-energize each said contact plate in sequence and close said charge valve at the point in the power stroke required to control the power and speed of said engine as desired.

2. I claim, the combination as described in claim number 1, and further comprising a combustion products generator to supply said pressure fluid medium, multistage air compressor cylinders with interstage cooling to supply combustion air to said combustion products generator, and a preheater for heating said combustion air by the exhaust from said power cylinders after compression and before entering said combustion products generator.

3. I claim the combination as described in claim number 1, and further comprising a cam on said camshaft to open each exhaust valve when said piston reaches bottom dead center, said exhaust valve cam to close each exhaust valve at a predetermined point in the exhaust stroke of said main power piston, whereby the compression above said piston reaches the pressure of the incoming charge of hot pressure fluid medium, thereby eliminating the losses due to the clearance between said piston and said cylinder head.

4. I claim in combination as described in claim number 1, a single acting, reciprocating piston engine consisting of one or more main power cylinders, designed to use the hot pressure fluid medium for power produced by a heating unit separate from said engine, a main power piston in each of said main power cylinders, comprising a head and a skirt, including piston seal rings thereon, a cylinder extension supported above said main power cylinder, the inside of said cylinder being slightly larger inside diameter than said main power cylinder, an insulation means surrounding said cylinder extension, a pressure holding cylinder extension surrounding said insulation means, a piston extension movable relative to said main power piston, said piston extension having slightly smaller outside diameter than the outside diameter of said main power piston, a means of securing said piston extension to said main power piston to provide for relative movement, said means comprising at least one opening in said main power piston head, at least one bolt means secured to said piston extension and extending through said opening, a spring biasing means acting on said bolt nut means, a pressure sealing cap means, removably secured to said opening and securing and covering said bolt means end, said nut means, and said spring biasing means to provide a pressure tight joint, a means of insulating said main power piston from the heat from said piston extension, consisting of an insulating means placed between said piston extension and said main power piston head.

5. I claim in combination, a reciprocating piston engine which uses a pressure fluid medium for power, said pressure fluid medium produced by combustion products generators a charge valve for said engine, a mechanical means to open the charge valves to the power cylinders of said engine, an electrical means to lock said valves open, a variable electrical means to release said charge valves so that the spring on said charge valves closes said valve at the point in the power stroke of said power pistons necessary to govern the speed and power of said engine as desired, a means to reverse the opening and closing of said charge valves at said cutoff point so as to control the power and speed of said engine as desired.

6. I claim in combination a reciprocating piston engine which uses pressure fluid medium for power produced by combustion products generators, having one or more main power pistons, one or more main power cylinders for said pistons to reciprocate in, a cylinder head containing charge and exhaust valves, to close the open end of said main power cylinder, an improved automatic cut off means for said charge valves, comprising an improved high speed electro magnetic means to open said charge valves when said main power piston reaches top dead center, a variable timer means to de-energize said electro magnetic means permitting the valve spring to close said charge valve at the point in the power stroke of said main power piston so as to control the power and speed of said engine as required, said variable means consisting of an electric contact drum cylindric in shape, supported by a shaft revolving in bearings driven by and in time with and at the exact speed of the crank shaft of said engine, said electric contact drum to be made of a material which is a non conductor of electricity, with metal contact segments imbedded in said non conductor material, with the outside flat faces of said segments coincident with the outer circumference of said contact drum, first, second, and third sole switching means, a source of electric power, the negative pole of said electric power source connected to said first pole switching means, to a contact brush in contact with said number 1 metal contact segment, said first segment extends completely around said contact drum, said first switching means consisting of a pivot pole, a means to connect said pivot pole to one of the contact points of said first switching means, a second metal contact segment, separate from the first contact segment, around 180° of said contact drum for each charge valve, two stationary contact brushes located 180° apart on the circumference of said contact drum, in contact with said second contact segment, each brush connected to the opposite pole of said second pole switching means, the positive pole of said electric power source connected to said electro magnetic means to open said charge valves, thence to a pivot pole of said second pole switching means, a third metal contact segment, separate from the first and second segments, around the opposite 180° of the circumference of said contact drum, from the second segment, two moveable contact brushes located 180° apart, in contact with the third contact segment, connected to the opposite poles of said third pole switching means, said switching means consisting of a pivot pole and a means to connect said pivot pole to one of said contact points in said third means, the negative pole of said electric power connected to said pivot pole of said third pole switching means, means interconnecting the first, second, and third contact segments, a means of oscillating said contact brushes of said third segment in a concentric, circular arc, in contact with the third contact segment, from a point of said charge valves not opening at all, to being open 90° of the power stroke of said power piston, thereby controlling the speed and power of said engine as required, the degrees of the circle that the brush of the third contact segment is from the brush of the second contact segment controls the point that the electric circuit is broken to de-energize said electro magnet holding said charge valve open, permitting said valve spring to close said charge valve.

* * * * *